US006243050B1

(12) United States Patent
Powell

(10) Patent No.: US 6,243,050 B1
(45) **Date of Patent: *Jun. 5, 2001**

(54) DOUBLE-STACKED HOURGLASS LOG PERIODIC DIPOLE ANTENNA

(75) Inventor: Charles M. Powell, Holland, PA (US)

(73) Assignee: Radio Frequency Systems, Inc., Marlboro, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,117

(22) Filed: Jan. 7, 1998

Related U.S. Application Data

(63) Continuation-in-part of application No. 08/807,560, filed on Feb. 28, 1997, now abandoned.

(51) Int. Cl.[7] ..... H01Q 11/10

(52) U.S. Cl. ..... 343/792.5; 343/793

(58) Field of Search ..... 343/700 MS, 792.5, 343/793, 794, 795, 813, 815, 817; H01Q 11/10

(56) References Cited

U.S. PATENT DOCUMENTS

| | | | | |
|---|---|---|---|---|
| 3,079,602 | | 2/1963 | Hamel et al. | 343/895 |
| 3,181,161 | * | 4/1965 | Minerva | 343/792.5 |
| 3,193,831 | * | 7/1965 | Yang | 343/792.5 |
| 4,785,307 | | 11/1988 | Kuo | 343/792.5 |
| 4,825,220 | | 4/1989 | Edward et al. | 343/795 |
| 4,907,011 | | 3/1990 | Kuo | 343/792.5 |
| 5,532,708 | | 7/1996 | Krenz et al. | 343/795 |
| 5,629,713 | | 5/1997 | Mailandt et al. | 343/808 |
| 5,666,126 | | 9/1997 | Lange | 343/781 R |

FOREIGN PATENT DOCUMENTS

| | | | | |
|---|---|---|---|---|
| 953805 | * | 4/1964 | (BR) | 343/792.5 |
| 1286590 | | 1/1962 | (DE) . | |
| 0034384 | * | 8/1980 | (DE) | 343/792.5 |
| 33 38 444 A1 | | 5/1985 | (DE) . | |
| 817304A | | 1/1998 | (EP) . | |

OTHER PUBLICATIONS

T.E. White, "a Multi–Mode Beam for CB and 10 Meters", CQ, and pp. 26–27, May 1979.*

A. Singer, "Base Station Antennas for Digital Cellular Systems", Mobile Radio Technology, U.S., Intertec Publishing Corporation, vol. 13, No. 10, Oct. 1, 1995 (Oct. 1, 1995), pp. 12–14, 16, 18.

Richard C. Johnson, *Antenna Engineering Handbook*, 3rd Edition, Copyright 1993 by McGraw Hill, p. 14–34 (Figures 14–30, 14–31 & 14–32). (No month provided).

Derwent WPI English abstract of Buck +/Hirschmann DE 33 38 44–A, published May 2, 1985.

Patent Abstracts of Japan, abstract of Fuji +/Japan Radio Publ. No.: 02–260 803 published Oct. 23, 1990 (application 01–078 567 filed Mar. 31, 1989, entitled Log Periodic Dipole Antenna).

* cited by examiner

*Primary Examiner*—Tho G Phan
(74) *Attorney, Agent, or Firm*—Ware, Fressola, Van Der Sluys & Adolphson LLP

(57) ABSTRACT

An improved log periodic dipole antenna, adapted for use in a cellular telephone system, has a plurality of radiating elements with differing lengths. The sequence of lengths selected results in a horizontal beam width of about 65 degrees and a front-to-back signal strength ratio exceeding 45 dB. This combination of characteristics reduces interference among adjacent cellular telephone transmitter sites, and reduces waste of transmission energy from the back of the antenna. A preferred sequence of radiating element lengths is long-short-long-short-long, which may be described as a "double stacked hourglass" configuration.

10 Claims, 12 Drawing Sheets

DOUBLE-STACKED HOURGLASS LOG PERIODIC DIPOLE ANTENNA

CROSS-REFERENCE TO RELATED APPLICATIONS

This application is a continuation-in-part of U.S. Ser. No. 08/807,560, POWELL & YARSUNAS, filed Feb. 28, 1997, now abandoned, the disclosure of which is incorporated by reference.

FIELD OF THE INVENTION

The present invention relates generally to log periodic dipole antennas (LPDA) and, more particularly, to an improved log periodic dipole antenna which is particularly well adapted for use at a cell transmitter site in a cellular telephone system.

BACKGROUND

Dipole antennas have long been used in various communications systems, including radio, television, and radiotelephone systems. It is well known that the lengths of the dipole arms on the antenna should be adapted to the wavelengths ($\lambda$) of the signals transmitted and received. Typically, a plurality of arms having different lengths are used, in order to cover a predetermined range of frequencies. The sequence and spacing of these arms, and of any reflector behind them, determines various characteristics of the resulting beam or radiation field. These characteristics include vertical beam width, horizontal beam width, and front-to-back (F/B) ratio, i.e. the ratio of signal strength in front of the antenna to signal strength in back of the antenna. When a number of different arms are used, each arm makes its own contribution to the resulting field, and the overall expected result rapidly becomes difficult to calculate mathematically in advance. Therefore, considerable experimentation is often needed to achieve desired beam characteristics.

A well-known log periodic dipole antenna (LPDA) design is the "tree" configuration, in which parallel arms extend sideways from a central "trunk" or "standoff," the bottom arm near the base is the longest, and each successive arm is shorter toward the top of the antenna. Such LPDA designs typically result in a front-to-back (F/B) ratio less than 40 dB. This F/B ratio is considered insufficient for use in current PCS (Personal Communication System) cellular telephone sites, since radiation emanating out the back of the antenna tends to cause interference among adjacent sites. A horizontal beam width of 90 degrees is typical. However, in highly congested urban environments, it is preferable to have horizontal beamwidth of 65 degrees, which is obtained by using two parallel columns of dipoles, spaced 0.25 $\lambda$ to 0.30 $\lambda$ apart. The wavelength lambda ($\lambda$) is the inverse of the frequency. The frequency band allotted for PCS use in the United States is between 1.85 GigaHertz and 1.99 GigaHertz, with a center frequency 1.92 GHz. The PCS band allotted in Europe has a center frequency 1.78 GHz, meaning that the wavelength is about 8% greater. Accordingly, antenna dimension examples stated for the U.S. should be scaled up about 8% for use in Europe.

My earlier LPDA design work has included an "hourglass" dipole strip configuration, in which top and bottom arms are longer than one or more middle arms. This design works well for generating a 90 degree beamwidth, but when used for generating a 65 degree beamwidth, typically results in F/B ratios in the range between 37 dB and 42 dB, better than provided by the "tree" configuration, but still insufficient. Reference is made to pending application U.S. Ser. No. 08/807,560 by myself and a colleague.

SUMMARY OF THE INVENTION

Accordingly, it is an object of the present invention to provide an improved log periodic dipole antenna in which the horizontal beam width is 65 to 70 degrees and the front-to-back ratio is at least 45 dB.

Briefly, this combination of beam characteristics has been achieved by a "double stacked hourglass" configuration, in which, from the antenna base outwards, the lengths of the dipole arms follow a sequence long-short-long-short-long. The antenna is center-fed with a radio frequency signal. An air dielectric microstrip carries a transmission signal from a feedpoint, where a cable is connected, to the dipoles. There are two columns of parallel radiating elements, spaced about 0.27 $\lambda$ apart. The spacing between adjacent pairs of radiating elements is about 0.9 $\lambda$ to 1.0 $\lambda$. The horizontal beam width is about 65 degrees.

BRIEF FIGURE DESCRIPTION

DETAILED DESCRIPTION OF THE PREFERRED EMBODIMENT

Figure 1A:
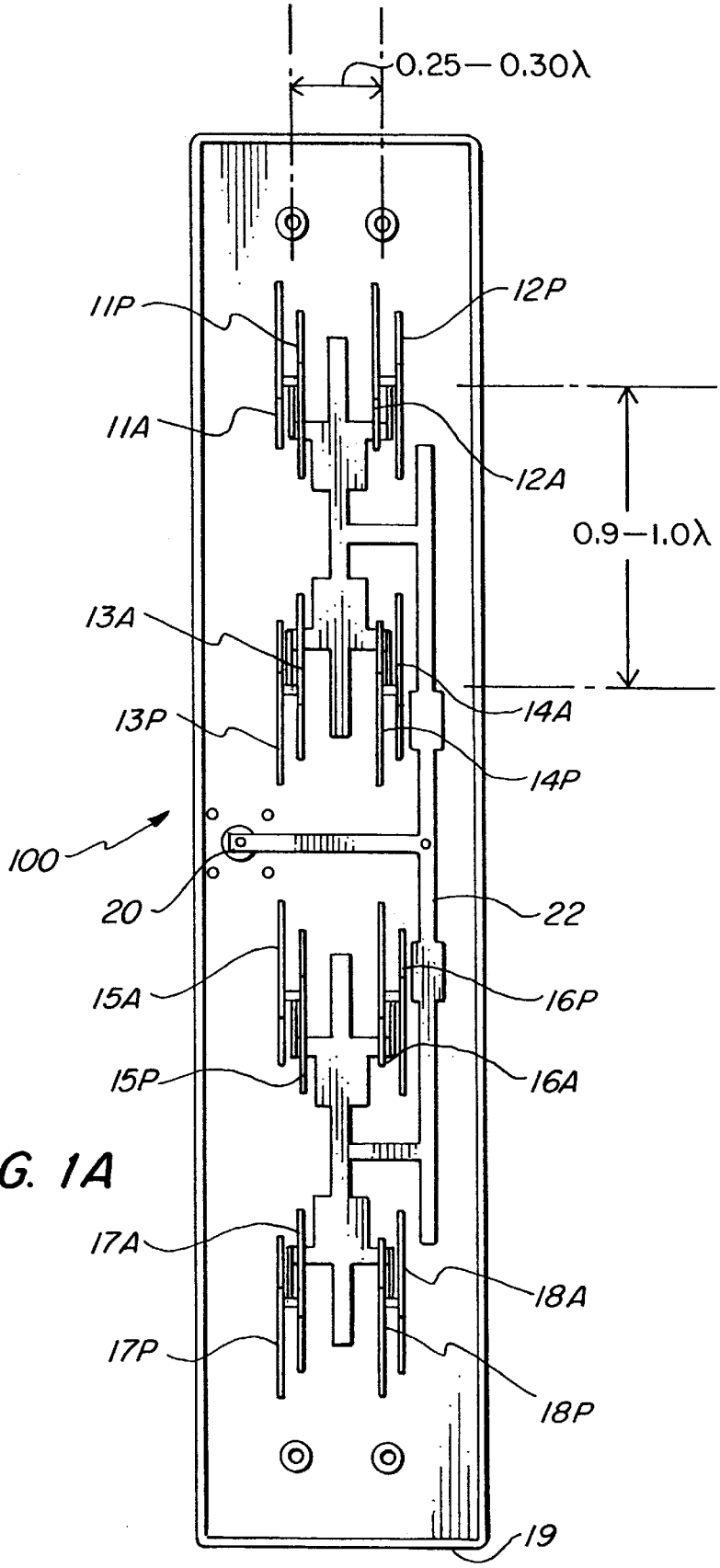
FIGS. 1A–1E illustrate a dipole array configuration of 8 radiating elements for an antenna having a sixty-five degree beamwidth.

FIG. 1A illustrates a log periodic dipole antenna configuration 100 adapted to produce a beam about 65 degrees wide in azimuth when the antenna configuration is oriented with its longer dimension perpendicular to the earth. It includes a left column of radiating elements 11, 13, 15, 17 and a right column of radiating elements 12, 14, 16, 18, all mounted on a metallic reflector plate 19. The left and right columns are suitably spaced about 0.27 $\lambda$ apart horizontally, where $\lambda$ is the wavelength of the intended central operating frequency of the antenna, e.g. 1.92 GHz in North America for the PCS (Personal Communications System) band 1.85–1.99 GHz. Alternatively, a single column could be used, with a wide reflector. The vertical spacing between the rows of radiating elements is suitably about 0.9 to 1 λ. Multiple rows are used, in order to narrow the vertical beamwidth, since most cellphone users are in a plane along the horizon, and the beam should be directed there.

A signal is fed to the antenna via a feedpoint 20, which may be a coaxial connector extending through an opening in reflector plate 20, for connecting a coaxial cable (not shown) on the side of the reflector plate remote from the radiating elements. Preferably, a microstrip feedline 22 extends from feedpoint 20 to all of the radiating elements. However, it is known in the antenna art to feed the dipoles in other ways, e.g. by cables or printed circuit board tracks. Each radiating element consists of two parallel dipole strips, one active and one passive, e.g. 11A & 11P, and a center feed conductor 24 (shown in FIGS. 1C & 1E) between the dipole strips. Center feed conductor 24 has a bottom end connected to microstrip feedline 22, and a top end connected to one of the dipole strips. The connected strip is the active dipole strip, since it is supplied with the signal from feedpoint 20. The unconnected dipole strip is the passive strip. In FIG. 1A, the active strips are designated with the suffix "A" and the passive strips are designated with the suffix "P." Preferably, there is an alternation, from row to row, in whether the left strip or the right strip is active. This helps to produce a radio beam whose center is directly perpendicular to the reflector.

Figure 1B:
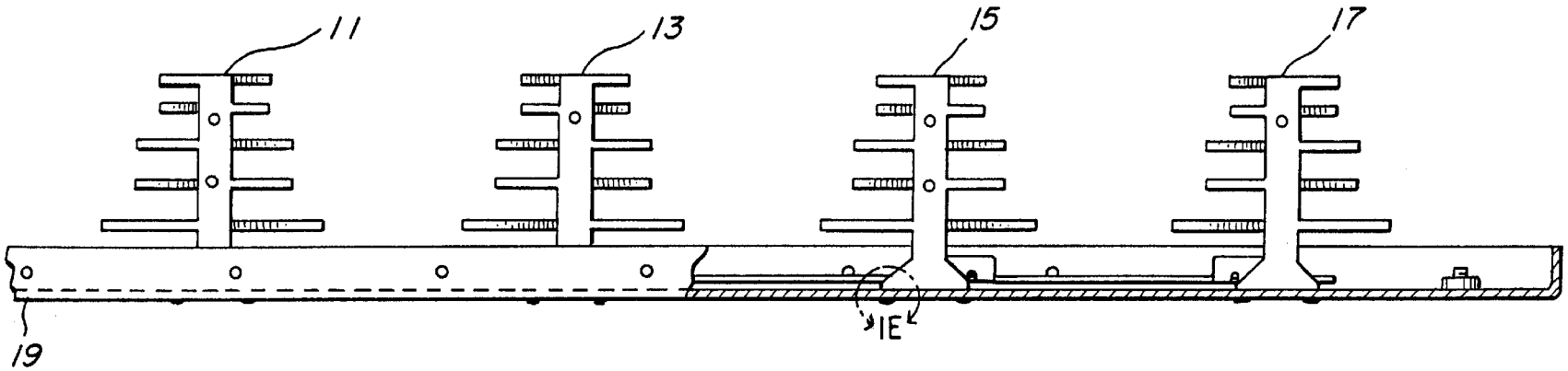

FIG. 1B is a side view, showing four radiating elements extending from the reflector.

Figure 1D:
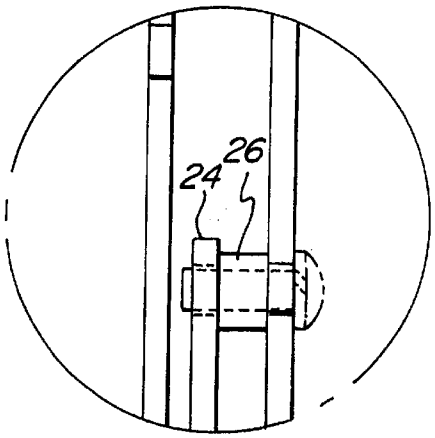
Figure 1E:
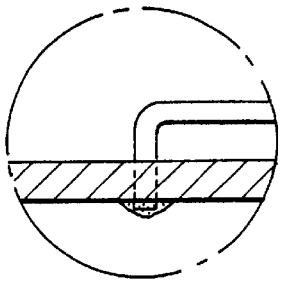
Figure 1C:
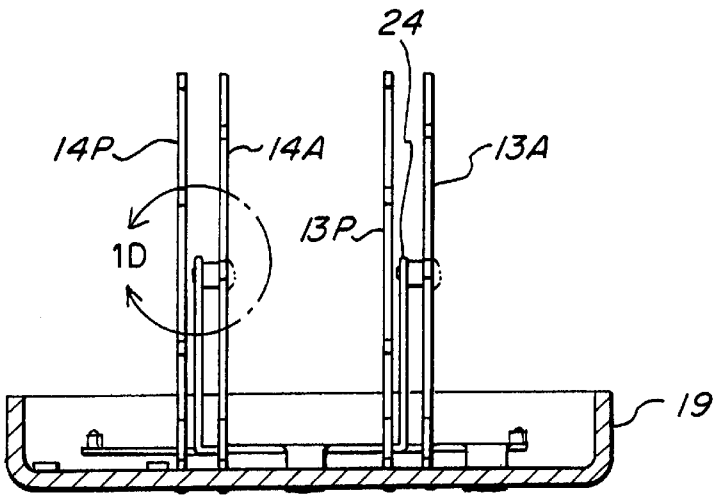

FIG. 1C is another side view, showing two radiating elements edgewise, each with a center feed conductor 24 connecting about halfway up the active dipole strip. The dipole strips can be made of aluminum sheet having a thickness of about 0.063 inches (1.6 mm). Preferably, a dielectric spacer is provided between upper ends of the active and passive dipole strips to provide mechanical stability. A suitable spacer material is polytetrafluoroethylene (PTFE), also known by the trademark TEFLON.

FIG. 1D is an enlarged detail view, showing in section a metal ring or nut 26 which is bolted or screwed between center feed conductor 24 and the active strip. FIG. 1E is another enlarged detail view, showing how the dipole strip is connected to the reflector plate.

Figure 2:
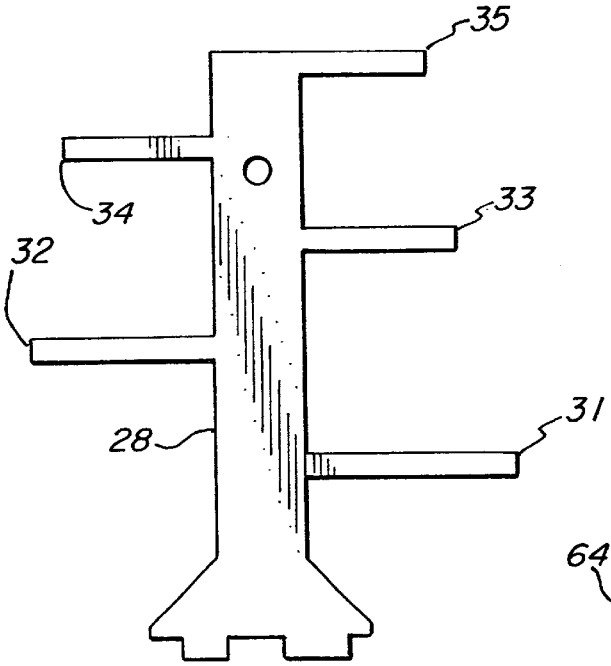
FIG. 2 shows a "tree" dipole radiating element.

As shown in FIG. 2, each dipole strip has a central "trunk" or "standoff" 28 which extends outward from a base at reflector plate 19, and has a plurality of arms or branches 31–35 extending perpendicularly sideways from the standoff. The arms extend alternately to left and to right from the standoff. In each radiating element, respective arms of the active and passive dipole strips extend in opposite directions. For example, if the bottom-most arm of the active strip extends left, the bottom-most arm of the passive strip extends right. In a conventional "tree" dipole, the arms become progressively shorter as the distance from reflector plate 19 increases.

Figure 3A:
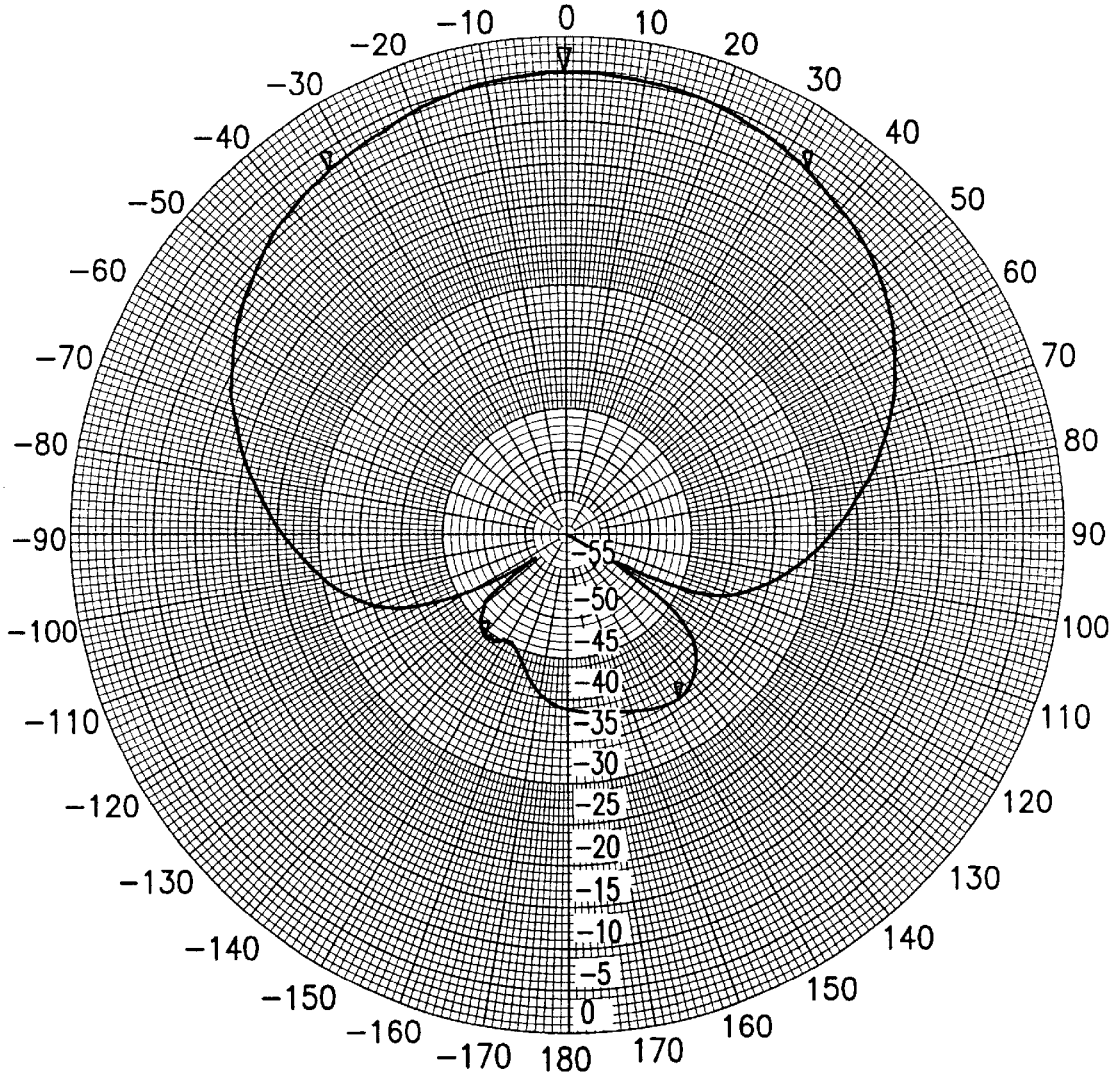
FIG. 3A shows the radiation pattern of the tree dipole at 1.85 GHz.
Figure 3B:
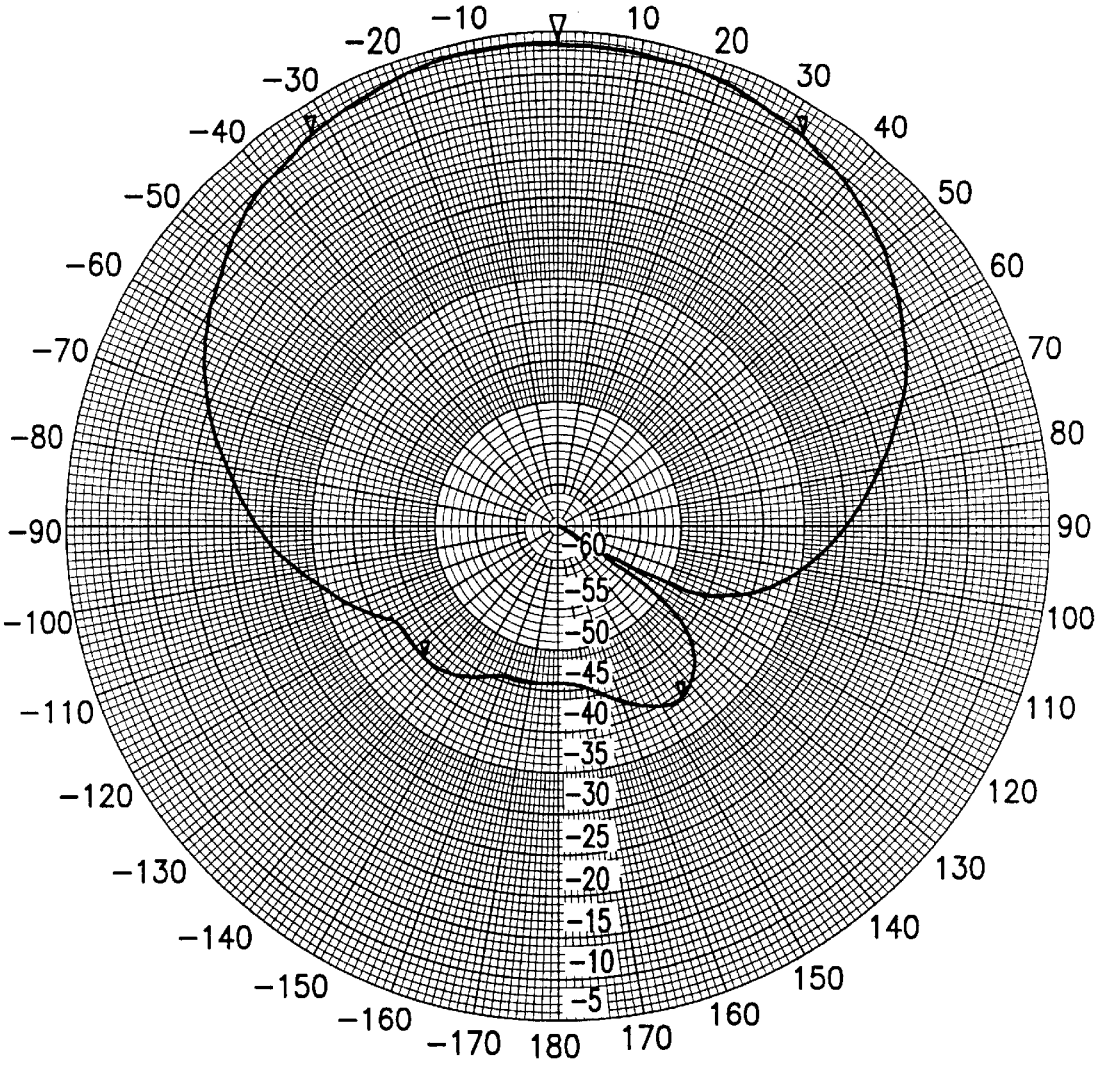
FIG. 3B shows the radiation pattern of the tree dipole at 1.92 GHz.
Figure 3C:
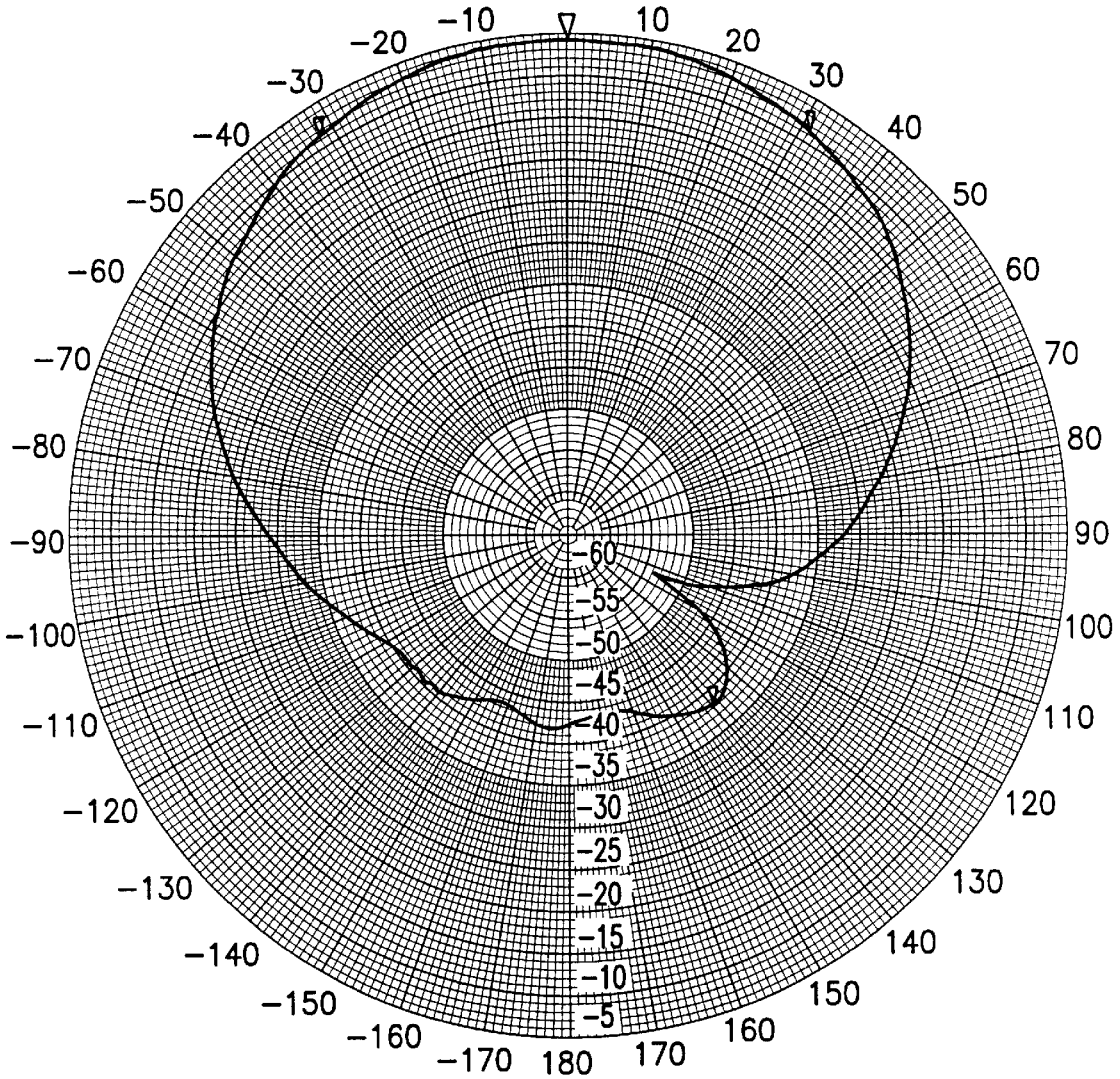
FIG. 3C shows the radiation pattern of the tree dipole at 1.99 GHz.

FIG. 3A illustrates the azimuth radiation pattern at a frequency of 1.85 GHz of a "tree" dipole antenna according to FIG. 2. As shown, the beamwidth is about 66 degrees and the front-to-back ratio is about 35 dB, which today is considered inadequate. FIG. 3B illustrates the azimuth radiation pattern of the same antenna at 1.92 GHz. The beamwidth is about 65 degrees and the F/B ratio is not quite 40 dB. FIG. 3C illustrates the azimuth radiation pattern of the same antenna at 1.99 GHz. The beamwidth is about 63 degrees and the F/B ratio is about 36 dB.

Figure 4:
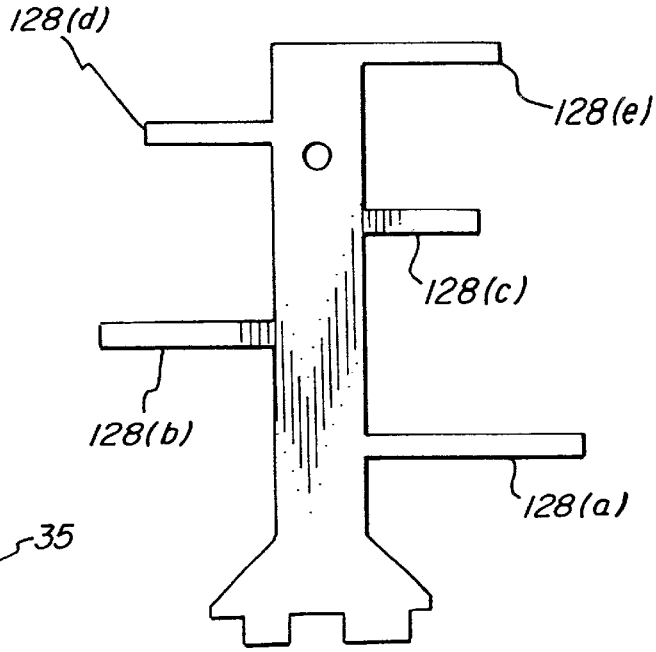
FIG. 4 shows an "hourglass" dipole radiating element, in which the top and bottom arms are longer than the middle arms.

FIG. 4 shows an "hourglass" dipole strip structure, as disclosed in FIG. 9 of my earlier U.S. patent application 08/807,560, filed Feb. 28, 1997. That application was directed primarily to production of a 90 degree azimuth beamwidth, but the same radiating elements can arranged in an array for production of a 65 degree azimuth beamwidth. As shown, the five dipole arms 128(*a*), 128(*b*), 128(*c*), 128(*d*) and 128(*e*) have respective lengths whose ratios are 1.53, 1.257, 0.93, 0.98 and 1.047, i.e. the middle arm is shorter than the bottom and top arms. The outer contour of this structure is shaped like an hourglass, which is the reason for the name given to the structure. This structure provides a better F/B ratio than the "tree" dipole structure, but the result is still less favorable than desired.

Figure 5A:
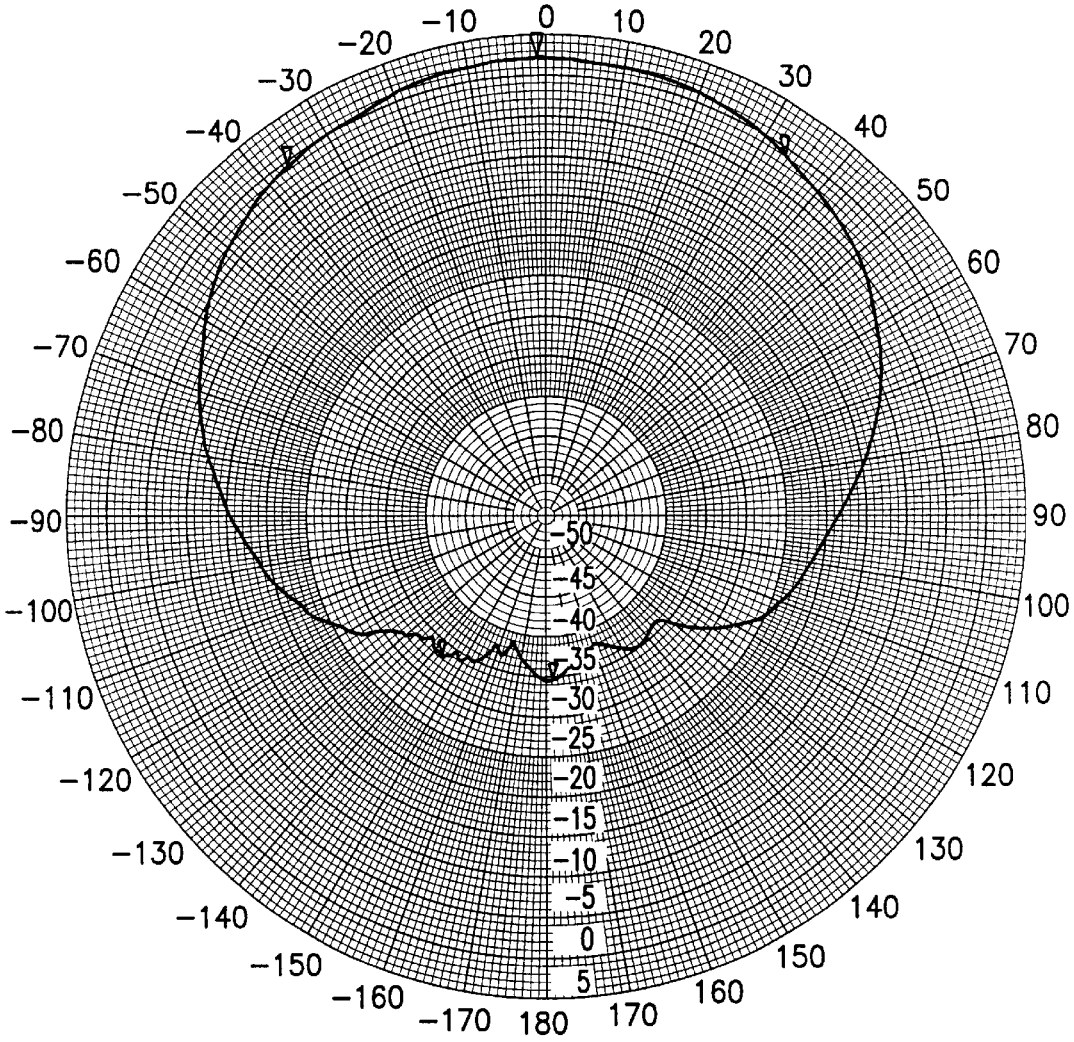
FIG. 5A shows the radiation pattern of the hourglass dipole at 1.85 GHz.
Figure 5B:
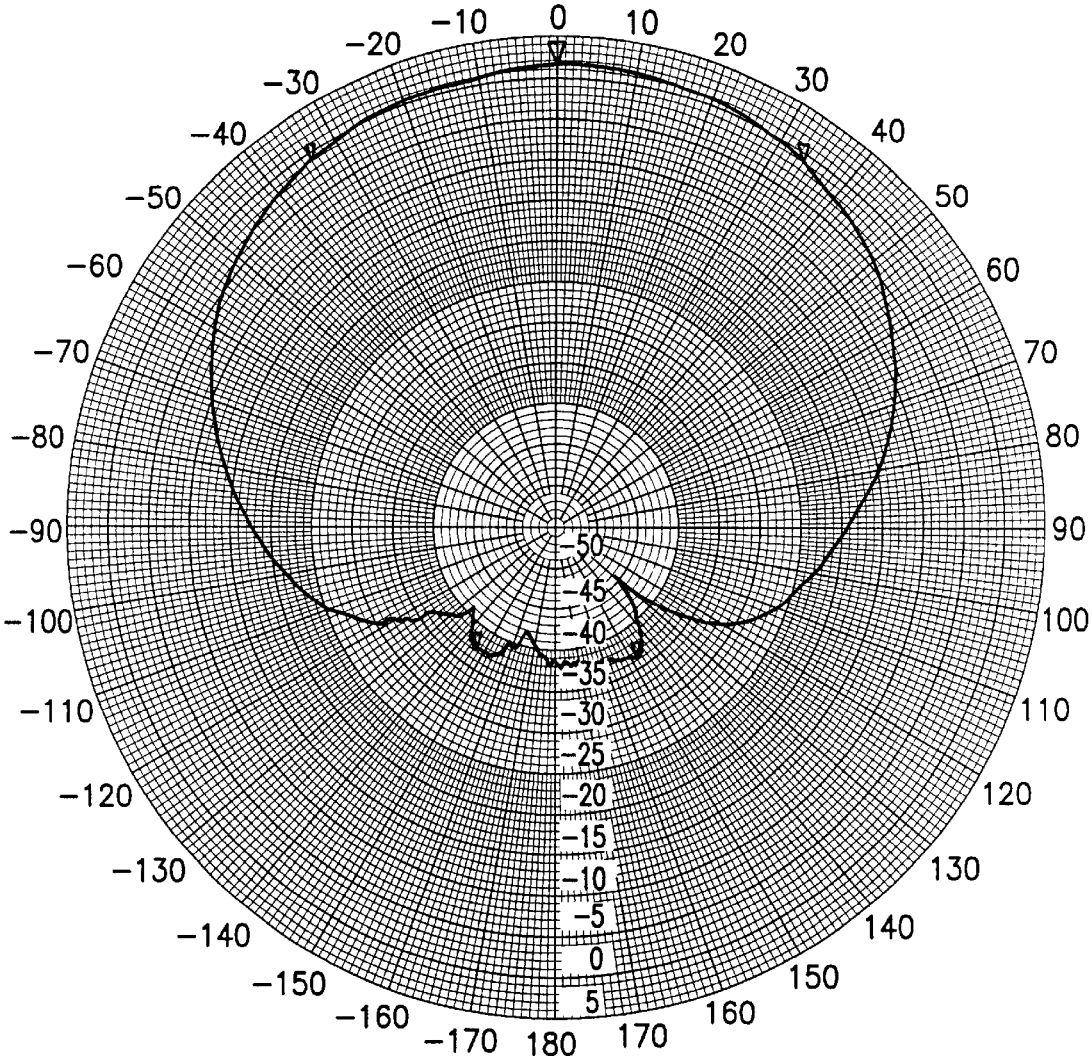
FIG. 5B shows the radiation pattern of the hourglass dipole at 1.92 GHz.
Figure 5C:
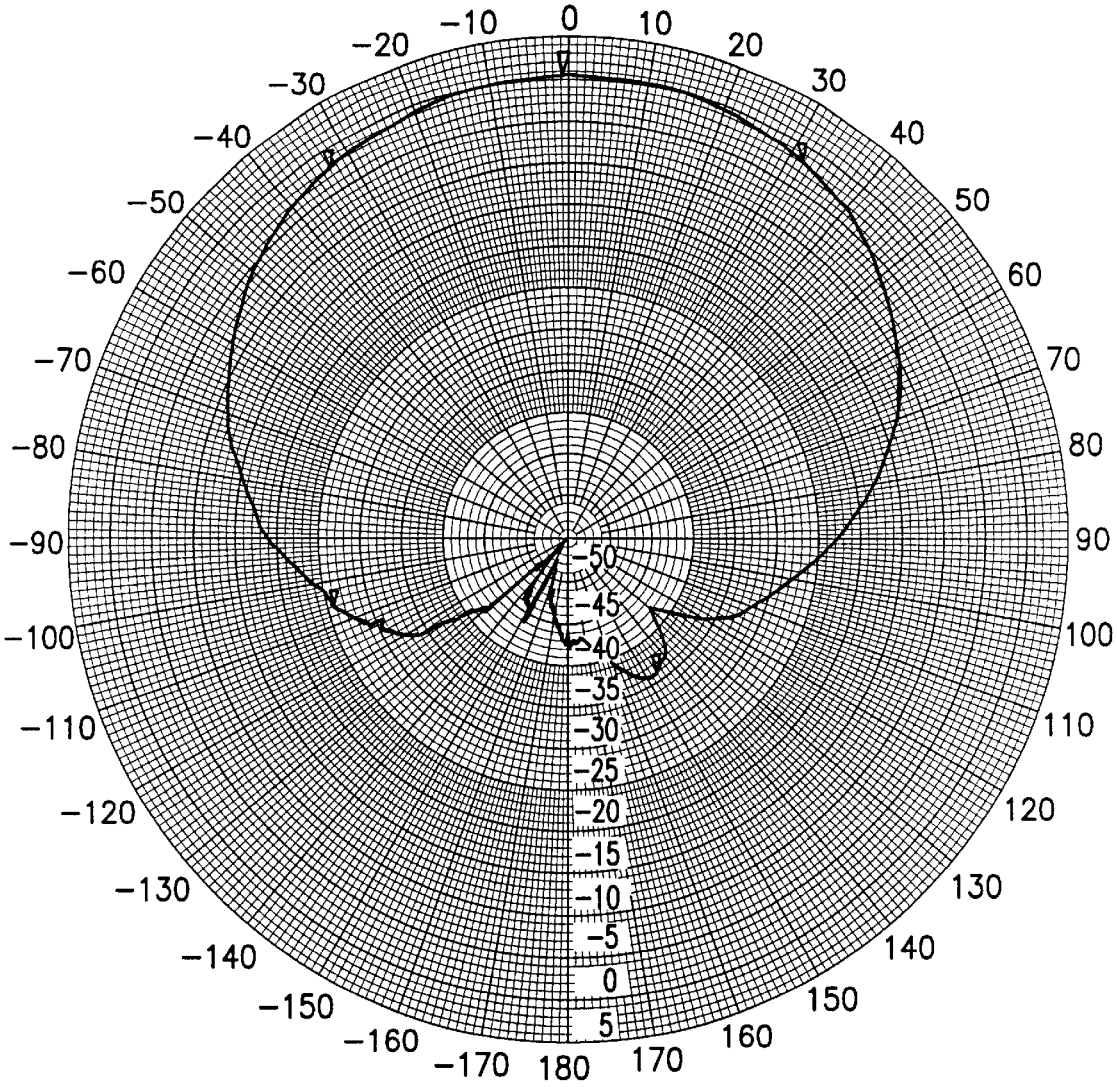
FIG. 5C shows the radiation pattern of the hourglass dipole at 1.99 GHz.

FIG. 5A illustrates the azimuth radiation pattern at a frequency of 1.85 GHz of an "hourglass" dipole antenna according to FIG. 4. As shown, the beamwidth is about 70 degrees and the front-to-back ratio is about 37 dB. FIG. 5B illustrates the azimuth radiation pattern of the same antenna at 1.92 GHz. The beamwidth is about 69 degrees and the F/B ratio is not quite 40 dB. FIG. 5C illustrates the azimuth radiation pattern of the same antenna at 1.99 GHz. The beamwidth is about 65.5 degrees and the F/B ratio is about 42 dB.

Figure 6:
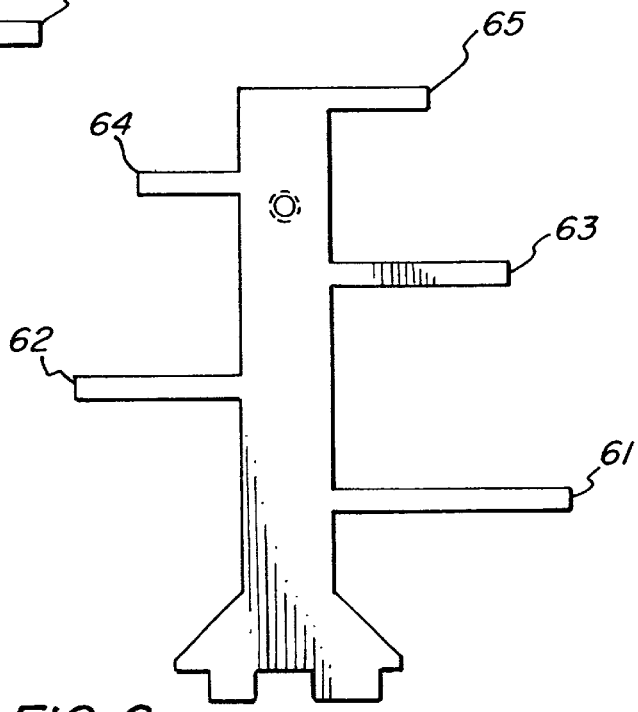
FIG. 6 shows a "double-stacked hourglass" dipole radiating element in accordance with the present invention.

FIG. 6 shows a "double stacked hourglass" dipole strip structure in accordance with the present invention. As shown, the five dipole arms 61–65 have respective lengths in the sequence long-short-long-short-long. In a preferred embodiment, their ratios are 1.598, 1.139, 1.25, 0.795, and 0.817, i.e. the second arm 62 is shorter than the bottom arm 61 and middle (third) arm 63, and the fourth arm 64 is shorter than the middle (third) arm 63 and top (fifth) arm 65.

Figure 7A:
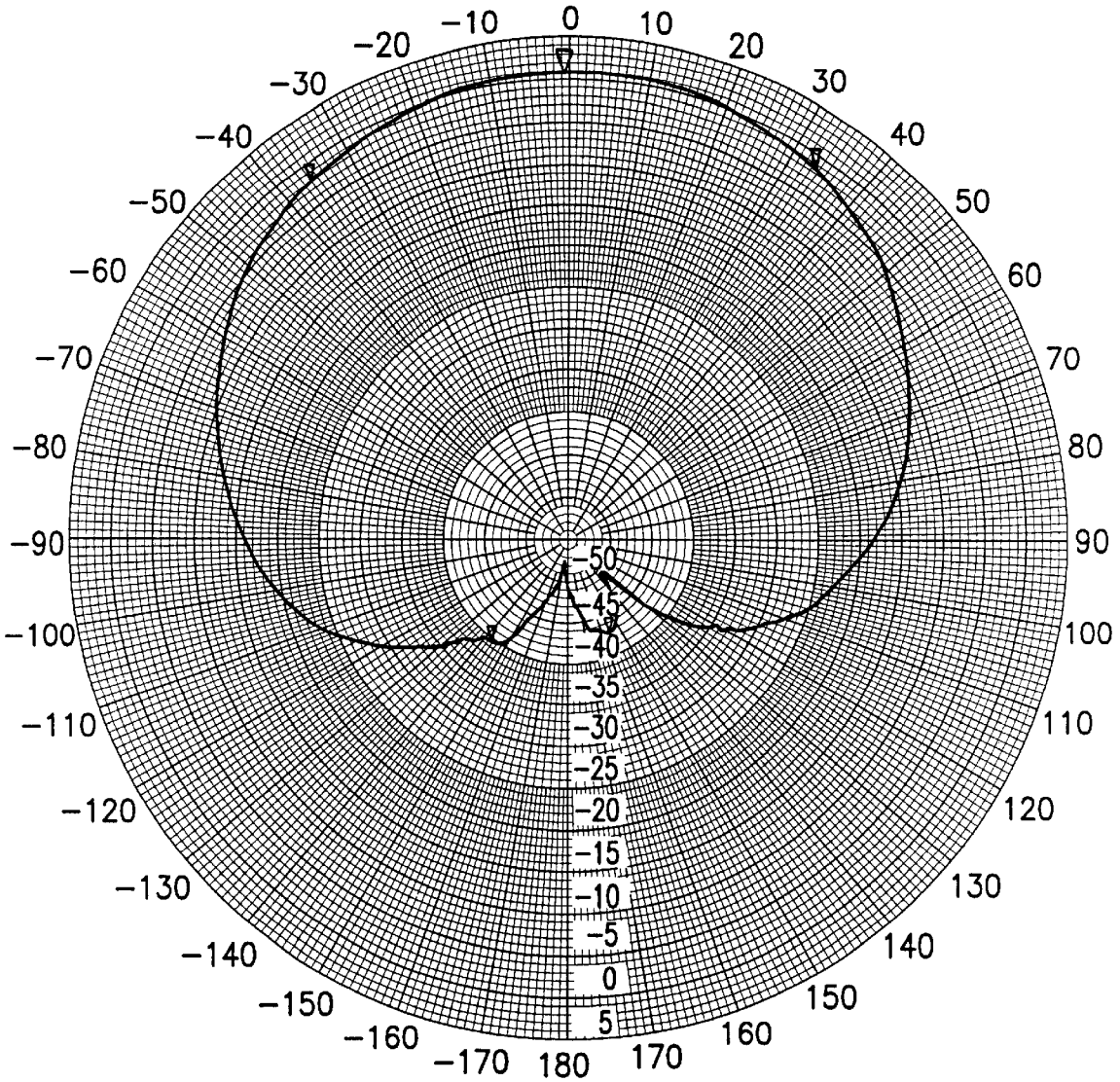
FIG. 7A shows the radiation pattern of the double-stacked hourglass dipole at 1.85 GHz.
Figure 7B:
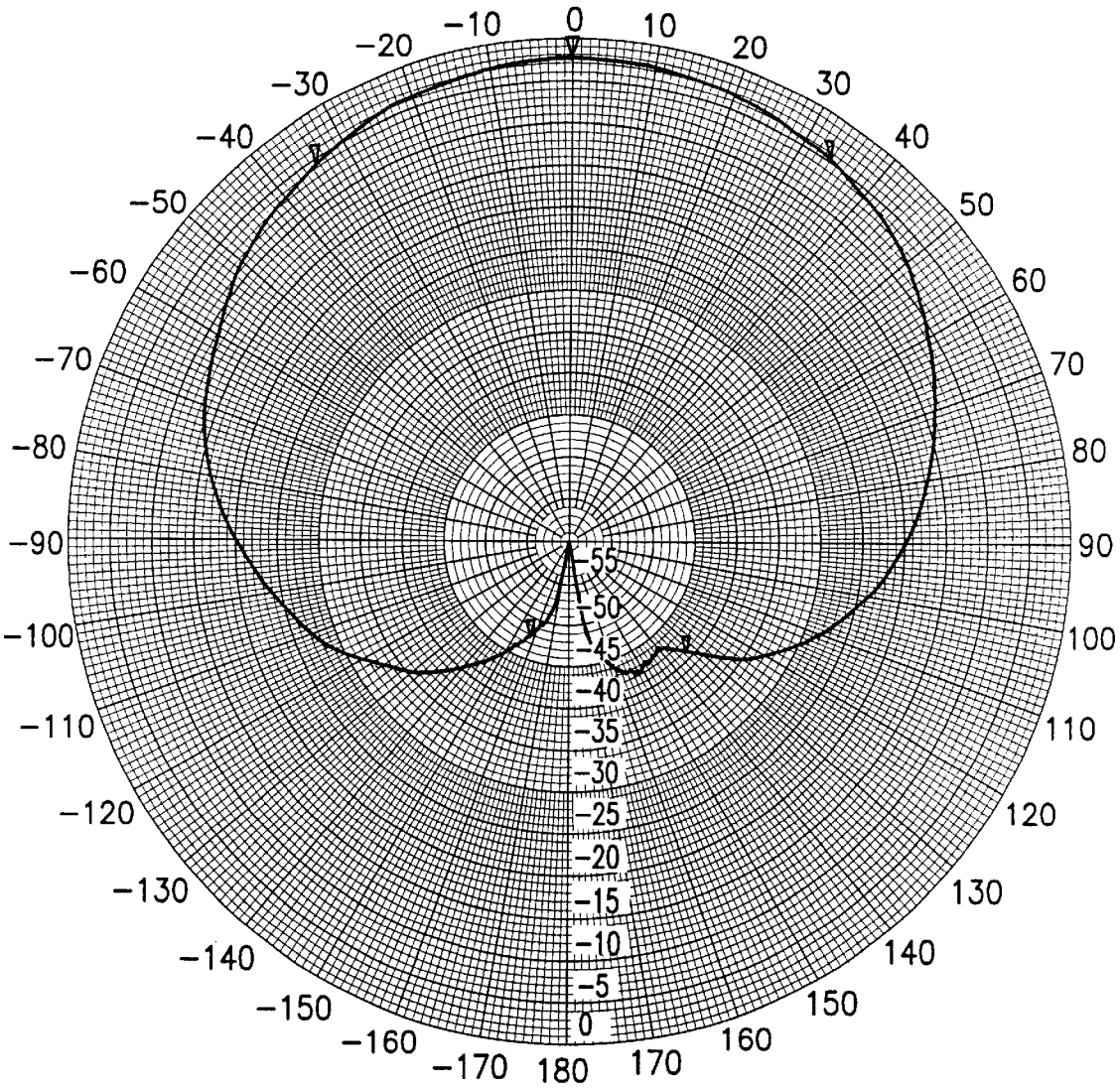
FIG. 7B shows the radiation pattern of the double-stacked hourglass dipole at 1.92 GHz.
Figure 7C:
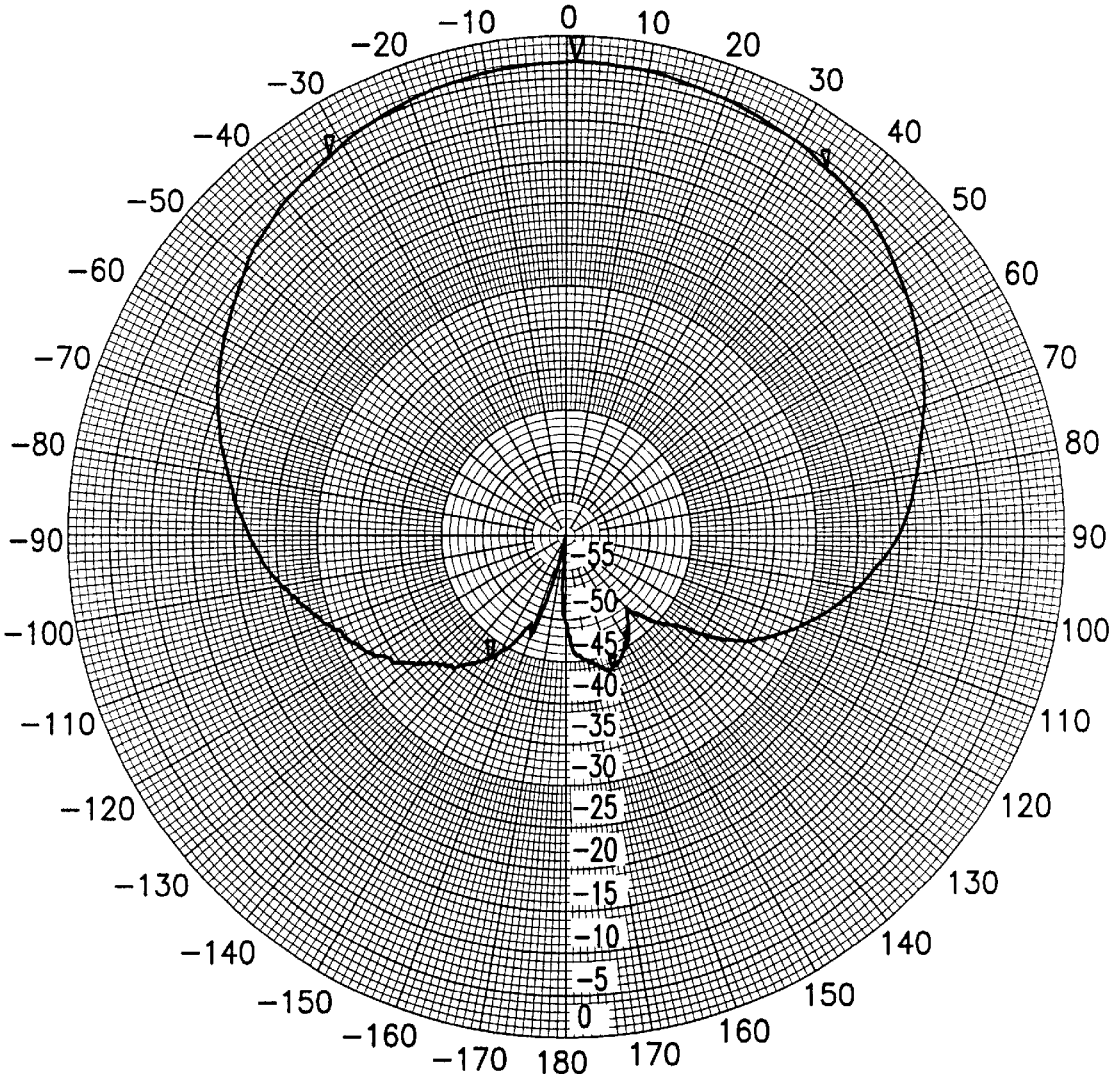
FIG. 7C shows the radiation pattern of the double-stacked hourglass dipole at 1.99 GHz.

FIG. 7A illustrates the azimuth radiation pattern at a frequency of 1.85 GHz of a "double stacked hourglass" dipole antenna according to FIG. 6. As shown, the beamwidth is about 70 degrees and the front-to-back ratio is about 50 dB. FIG. 7B illustrates the azimuth radiation pattern of the same antenna at 1.92 GHz. The beamwidth is about 68 degrees and the F/B ratio is over 57 dB. FIG. 7C illustrates the azimuth radiation pattern of the same antenna at 1.99 GHz. The beamwidth is about 66.5 degrees and the F/B ratio is about 46 dB.

These F/B ratios are much greater than the "tree" dipole F/B ratios of 35, 40, and 37, (FIGS. 3A–3C) and are a major improvement over the F/B ratios of 37, 40, and 42 (FIGS. 5A–5C) ratios of my earlier "hourglass" design. This improved F/B ratio reduces interference among adjacent cell sites, and conserves energy by preventing wasted emissions out the back of the antenna.

The relevant data for the plots shown in FIGS. 3A–3C, 5A–5C and 7A–7C is summarized in the following table:

| FIG | FREQ | BEAM PEAK | BEAM WIDTH | F/B RATIO | SIDELOBE DEGREE | SIDELOBE DB | SIDELOBE DEGREE | SIDELOBE DB |
|---|---|---|---|---|---|---|---|---|
| 3A | 1.850 GHz | 0.16 deg. | 66.30 deg. | −34.466 dB | −140.50 | −39.74 | 146.25 | −31.86 |
| 3B | 1.920 GHz | 0.37 deg. | 64.73 deg | −39.578 dB | −135.41 | −36.06 | 144.59 | −33.42 |

-continued

| FIG | FREQ | BEAM PEAK | BEAM WIDTH | F/B RATIO | SIDELOBE DEGREE | SIDELOBE DB | SIDELOBE DEGREE | SIDELOBE DB |
|---|---|---|---|---|---|---|---|---|
| 3C | 1.990 GHz | −0.38 deg | 62.82 deg. | −36.361 dB | | | 138.69 | −33.28 |
| 5A | 1.850 GHz | −1.04 deg. | 69.74 deg. | −36.709 dB | −142.75 | −35.41 | 177.75 | −36.58 |
| 5B | 1.920 GHz | −0.01 deg. | 68.94 deg. | −39.578 dB | −147.00 | −38.48 | 147.50 | −37.66 |
| 5C | 1.990 GHz | −0.57 deg. | 65.51 deg | −42.491 dB | −105.75 | −26.10 | 145.75 | −36.03 |
| 7A | 1.850 GHz | −0.92 deg. | 70.13 deg. | −49.855 dB | −144.75 | −40.52 | 154.75 | −43.11 |
| 7B | 1.920 GHz | −0.12 deg. | 68.44 deg. | −57.642 dB | −158.00 | −45.48 | 133.75 | −38.59 |
| 7C | 1.990 GHz | 1.24 deg. | 66.43 deg. | −46.038 dB | −148.75 | −39.63 | 161.25 | −40.32 |

Those skilled in the art will appreciate that various changes and modifications are possible within the scope of the present invention, in order to adapt to other frequency bands or to other terrain conditions. Therefore, the invention is not limited to the particular embodiments shown and described, but rather is defined by the following claims.

What is claimed is:

1. A log periodic dipole antenna, comprising:

a microstrip feedline having a centerfeed conductor; and at least one log periodic double-stacked hourglass dipole assembly having two dipole strips with a dipole strip connector, the microstrip feedline being arranged between the two dipole strips, the dipole strip connector being coupled to the centerfeed conductor of the microstrip feedline.

2. A log periodic antenna according to claim 1, wherein the centerfeed conductor is arranged between the two dipole strips.

3. A log periodic antenna according to claim 1, wherein the dipole strip connector electrically connects one of the two dipole strips to the centerfeed conductor.

4. A log periodic antenna according to claim 1, wherein each of the two dipole strips includes a plurality of alternating radiating elements.

5. A log periodic antenna according to claim 4, wherein each log periodic double-stacked hourglass dipole assembly includes a plurality of dipoles, each being formed by a pair of adjacent alternating radiating elements on said two dipole strips.

6. A log periodic antenna according to claim 1, wherein the log periodic antenna further comprises a reflector; and wherein the microstrip feedline has at least one microstrip mounting portion arranged on the reflector.

7. A log periodic antenna according to claim 6, wherein the microstrip feedline includes an input feed portion arranged on the reflector and connected to an input connector for receiving the input radio signal.

8. A log periodic antenna according to claim 1, wherein the microstrip feedline includes a second centerfeed conductor; and wherein the log periodic antenna further comprises a second log periodic double-stacked hourglass dipole assembly having two dipole strips with a second hourglass dipole strip connector coupled to the second centerfeed conductor.

9. A log periodic antenna according to claim 8, wherein the second centerfeed conductor is arranged between the two dipole strips of the second log periodic double-stacked hourglass dipole assembly.

10. A log periodic antenna according to claim 1, wherein the at least one log periodic double-stacked hourglass dipole assembly includes radiating arms having respective lengths which follow a sequence long-short-long-short-long in the shape of a double-stacked hourglass.

* * * * *